US006006443A

United States Patent [19]

Karvinen

[11] Patent Number: 6,006,443

[45] Date of Patent: Dec. 28, 1999

[54] METHOD AND APPARATUS FOR APPLICATION OF A TREATMENT AGENT TO A MATERIAL WEB

[75] Inventor: Juha Karvinen, Siltakylä, Finland

[73] Assignee: Runtech Systems Oy, Jokihaara, Finland

[21] Appl. No.: 09/031,819

[22] Filed: Feb. 27, 1998

[30] Foreign Application Priority Data

Sep. 9, 1997 [FI] Finland ..... 973640

[51] Int. Cl.[6] ..... D21F 5/00; F26B 3/00

[52] U.S. Cl. ..... 34/446

[58] Field of Search ..... 34/443, 446, 455, 34/463, 465, 114, 117, 119, 122; 427/209, 210; 162/206, 207, 135, 136

[56] References Cited

U.S. PATENT DOCUMENTS

| | | | |
|---|---|---|---|
| Re. 28,968 | 9/1976 | Dove . | |
| 4,367,597 | 1/1983 | Iida et al. | 34/638 |
| 4,444,622 | 4/1984 | Dove . | |
| 4,689,895 | 9/1987 | Taylor et al. | 34/638 X |
| 5,211,813 | 5/1993 | Sawley et al. | 34/638 X |
| 5,355,595 | 10/1994 | Koivukunnas et al. . | |
| 5,416,980 | 5/1995 | Ilvespaa . | |
| 5,490,903 | 2/1996 | Chen et al. . | |
| 5,571,382 | 11/1996 | Berglund . | |
| 5,593,545 | 1/1997 | Rugowski et al. . | |
| 5,689,897 | 11/1997 | Schiel | 34/122 X |
| 5,749,158 | 5/1998 | Muller et al. | 34/122 X |

FOREIGN PATENT DOCUMENTS

| | | |
|---|---|---|
| 0464470B1 | 9/1996 | European Pat. Off. . |
| 7 1367 | 9/1986 | Finland . |
| 9 1301 | 2/1994 | Finland . |
| 9 1900 | 5/1994 | Finland . |
| 9 50863 | 4/1995 | Finland . |
| WO95/13426 | 5/1995 | WIPO . |

*Primary Examiner*—Henry Bennett
*Assistant Examiner*—Steve Gravini
*Attorney, Agent, or Firm*—Birch, Stewart, Kolasch & Birch LLP

[57] ABSTRACT

The present invention is related to a method of treating a material web in a paper or paperboard machine, in which method the moving web is treated with a gas, particularly with steam. At least one supplementary treatment agent is dosed into the stream of said gas and effected to travel along with said gas toward said material web. The invention also concerns an apparatus suited to implement the method.

12 Claims, 3 Drawing Sheets

METHOD AND APPARATUS FOR APPLICATION OF A TREATMENT AGENT TO A MATERIAL WEB

The present invention relates to a method for application of a treatment agent to a material web. The invention further concerns an apparatus for treating a material web.

BACKGROUND OF THE INVENTION

In the art, different methods are known suitable for application of treatment agents (chemicals) on a web in a paper machine or similar equipment. For instance, an embodiment has been disclosed with an objective to aid the takeoff of the paper web from the intermediate roll of the paper machine press section by means of dosing a web release agent into the lubrication spray of the press roll doctor element. The desired goal of this arrangement is to facilitate a portion of the added agent to pass into the nip between the doctor element and the press roll, therein forming a film on the roll surface. The function of the film formed by the chemical additive is to aid the takeoff of the web from the roll surface by virtue of, e.g., lowering or increasing the surface tension of water, depending on the composition of the agent used. Among other disadvantages, this prior-art embodiment is handicapped by the following drawbacks. When operating properly, the doctor element cleans the roll surface free from all water, deposits and possible residues of the chemical additive so effectively that the roll surface after doctoring will be dry with no film of the chemical additive remaining thereon. The effect of the chemical will be minimal and the chemical losses high. By contrast, if the chemical is allowed to pass through the nip between the doctor element and the roll, the unavoidable corollary is that the doctoring effect must be reduced, whereby web breaks and production losses will be encountered in the paper mill. Broadly, conventional application methods misuse the potential effect of chemical additives and frequently involve excessive consumption of the chemical.

It is an object of the present invention to provide an entirely novel arrangement for application of a variety of web treatment agents (chemicals) in a paper or paperboard machine. The goal of the invention is achieved by virtue of dosing the treatment chemical into the stream of a carrier gas such as steam and then applying the stream directly to the web surface via gas stream applicator device such as a steam box.

SUMMARY OF THE INVENTION

The invention relates to a method of treating a material web in a paper or paperboard machine, in which method the moving web is treated with a gas, particularly with steam. The invention is characterized in that at least one supplementary treatment agent is dosed into the stream of said gas and effected to travel along with said gas toward said material web. In a preferred embodiment of the method, the stream of said gas and said treatment agent is directed toward said material web by means of an application/distribution device such as a steam box.

The invention relates also to an apparatus for treating a material web, said apparatus comprising a gas application/distribution device such as a steam box adapted to direct and apply said gas, particularly steam, to a moving material web. The invention is characterized in that said apparatus includes means for dosing at least one supplementary treatment agent into the stream of said gas.

More specifically, the invention is characterized by what is stated in the appended claims.

The arrangement according to the invention has a number of significant benefits. Particularly, the treatment agent to be dosed can be carried in the gas stream with a high efficiency to the material web such as a paper web. The embodiment according to the invention can be used to accomplish a plurality of tasks. For instance, it can be employed in the dosing of a web release agent, whereby the agent is applied to the web prior to the intermediate roll from a steam box, for instance. Thus, a uniform film will be formed in the nip between the web and the roll surface, whereby the takeoff of the sheet from the roll becomes easier and safer than in the prior art. Thence, the web takeoff draw can be reduced to a minimum. Resultingly, no deterioration of paper web strength qualities will occur, because the web need not be tensioned for safe takeoff. Obviously, this leads to a reduced rate of web breaks and offers a potential margin of higher paper machine speed.

Moreover, the invention makes it possible to improve the efficiency of the paper machine press section by feeding a surface-tension-lowering agent into the injected steam. Then, the steam condensing on the paper web will transfer the surface-active agent to the web, whereby the desired effect is attained as the surface tension of the water in the web is lowered allowing a greater amount of water to be drained from the web under compression. Resultingly, the solids content of the paper web increases and the amount of steam required for drying the sheet is reduced. This has an immense economical importance, because the consumption of drying steam forms one of the largest singular cost items in papermaking. Through the above-described procedure, it becomes possible to affect the final quality of the paper web by modifying, among other qualities, the surface properties or strength parameters of the sheet so that the paper will attain a higher strength, improved wet strength properties or higher quality. When the applied agent gives the sheet a higher strength, also the production capacity of the paper machine will rise. On the other hand, if the applied agent can improve the paper quality, it is an advantage to printing houses, thus elevating the retail value of the product. Furthermore, modification of the paper surface tension value will affect ink absorption, and thus, the quality of printing.

Additionally, the dosed agent may inherently have lubricating qualities, or alternatively, the dosed agent can be complemented with a lubricating additive such as a silicon- or TEFLON-based component. Thus, it is possible to reach the mechanical control means, such as the valves, of the gas feed means comprising, e.g., a steam box inasmuch said mechanical elements in conventional embodiments tend to stick due to deficient lubrication. Owing to improved lubrication of valves, the steam box may be utilized with maximum efficiency for attaining optimal moisture profiles of the paper web.

BRIEF DESCRIPTION OF THE DRAWINGS

In the following, the invention will be examined in more detail with reference to the attached drawings in which.

DESCRIPTION OF THE PREFERRED EMBODIMENT

Figure 1:
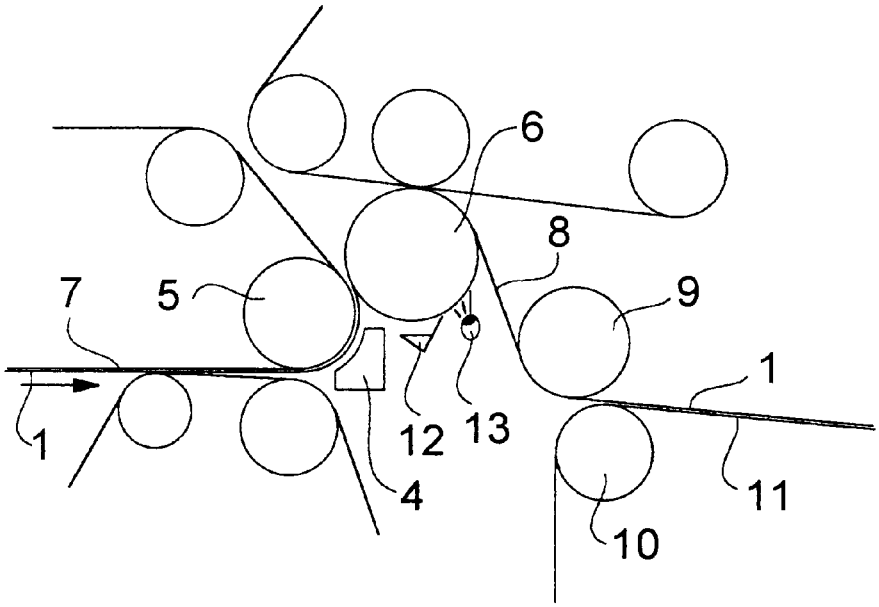
FIG. 1 shows schematically one type of the press section of a paper machine.

The method is suited for treating a web in a paper or paperboard machine, whereby the method is used as illustrated in the drawings to treat a moving web 1 with a gas jet, particularly a steam jet. In conjunction with jet application of the steam 2 is introduced at least one supplementary treatment agent 3, which is adapted to impinge with the gas stream on the web 1.

Figure 2:
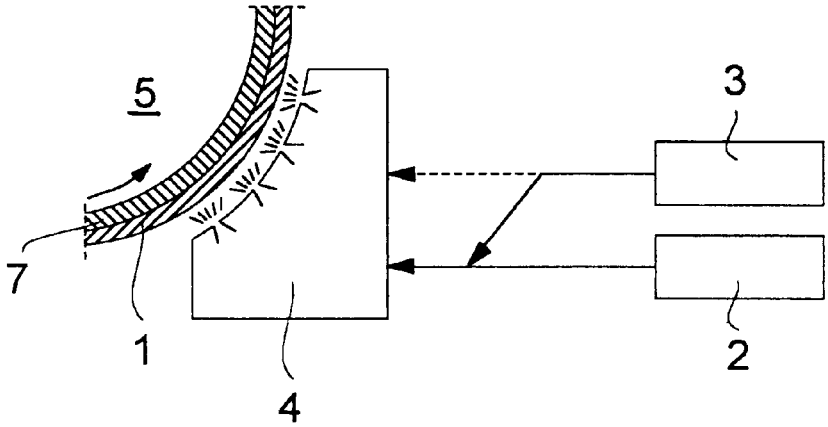
FIG. 2 shows schematically an embodiment according to the invention adapted to a point of use such as that illustrated in FIG. 1.

The carrier gas 2 with the entrained treatment agent 3 is directed onto the web by means of a distribution/application device 4 such as a steam box. The treatment agent 3 is mixed with the carrier gas in the distribution/application device (shown with a dashed line in FIG. 2) or in an inlet nozzle thereof.

The function of the treatment agent 3 is to affect at least one quality of the web 1, the properties of the web treatment devices, or both. The treatment agent can be in a gaseous, liquid or solid phase.

The application of the treatment agent is arranged to occur in a controlled manner. The state of the treatment agent is monitored and conditioned as required prior to feeding the agent into the gas stream.

The purpose of the treatment agent is to affect at least one of the following process qualities:

- web strength,
- web takeoff after the point of treatment from the surface of an applicator element such as a roll,
- water removal from the web by virtue of, e.g., affecting the surface tension properties, thus aiding the removal of water,
- surface properties of the web, and
- lubrication of the distribution/application device control means such as valves.

In present context, the term treatment agent is used in a broad sense also including effective combinations of a plurality of such active agents.

The method and apparatus according to the invention are suited for use in conjunction with a paper machine press section, for instance, such as the one shown in FIG. 1. In the diagram, only a partial view of the paper machine press section is illustrated. The press section shown in the diagram comprises a suction roll 5, an intermediate roll 6 and a steam box 4 adapted to direct the steam jet onto a paper web 1 led over the suction roll 5. Carried on the underside of a so-called pick-up felt 7, the paper web 1 is led onto the suction roll 5. Next, the web is passed over the intermediate roll 6 and led across an unsupported run 8 over a guide roll 9 to a lead-off suction roll 10. Therefrom, the web travelling supported on surface of the felt 11 is led to the next process step, e.g., to the next press section. In the press section shown in the diagram, the web is pressed against the suction roll 5 and the intermediate roll 6 three times altogether in order to increase the solids of the web 1. The steam box 4 is a conventional component used globally in over 90% of high-capacity paper machines. Steam boxes are described in, e.g., U.S. Pat. No. 4,444,622 and U.S. Pat. No. RE. 28,968. By virtue of the steam box 4, the temperature of the paper web 1 can be elevated, while the surface tension of water is simultaneously lowered. Thus, water removal from the web is improved during the pressing step and the paper machine capacity is increased due to the higher web solids. The higher the process temperature is elevated with the process water circulations preferably being formed into closed systems, the more difficult will be the leading of the web across the unsupported run 8 from the intermediate roll to the paper web guide roll 9. This web removal from the intermediate roll 6 is called web takeoff. In the prior art, an improvement to web takeoff has been attempted by way of applying a chemical to the surface of the intermediate roll via the lubrication spray 13 of the doctor 12. As mentioned above, in this method the proper function of the doctor 12 prevents a sufficient amount of the chemical from reaching the nip between the web 1 and the roll 6 so as to form therein a web takeoff-improving film of the chemical. Now, the embodiment according to the present invention offers an essential advantage by overcoming this problem and others recognized in the art.

In an embodiment of the method according to the invention (refer to FIG. 2) uses a steam box 4 for applying a chemical 3 to the surface of a paper web 1 in order to form a chemical film aiding the takeoff of the web 1 from the intermediate roll 6. The steam 2 injected from the steam box 4 acts as a carrier gas for the chemical 3, whereby an extremely efficient transport of the chemical 3 to the surface of the paper web 1 is attained. Thus, the consumption of the applied chemical is minimized and, simultaneously, optimal effect in web release is achieved. By varying the properties of the applied chemical, an additional facility is provided for the control of water removal in the nips 2–4, lubrication of valves (not shown) in the steam box 4 and improved performance of the doctor 12. Depending on the properties of the chemical, it is further possible to modify the quality and strength properties of the sheet in a desired manner. Obviously, the use of the steam box 4 for the transport of the chemical 3 poses certain requirements for the chemical itself and the dosing system of the chemical. The steam box 4 or similar gas stream applying/distributing device may be located on the wire section, press section or dryer of the paper machine.

Next, the function of the method is elucidated with the help of an exemplifying embodiment. In the case that the takeoff of the paper web from the intermediate roll 6 (to an unsupported run 8) is problematic, the situation can be improved in a web-release-improving manner by feeding a small amount of a chemical 3A with qualities tailored to affect the properties of the sheet or the roll. Then, the chemical 3A will be transported along with the steam stream to the web surface, forming between the web and the intermediate roll surface a film that improves the takeoff release of the web from the roll surface. In this fashion, the risk of web breaks is reduced and the surface cleanliness of the intermediate roll is improved because of the reduced tendency of roll surface contamination by debris released from the web. Hence, the function of the intermediate roll doctor 6 is also improved. Correspondingly, into the steam stream can be dosed a chemical 3B having a lubricating effect on the control elements such as the valves of the steam box. A further application of the method is to dose into the steam entering the steam box a chemical 3C with properties acting on the surface tension of water, whereby the chemical serves to modify the surface tension of water in the paper web so as to aid water removal from the web under pressure thus increasing the solids of the sheet at the outgoing side of the press section. Resultingly, energy saving will be gained in the dryer section of the paper machine. Moreover, the higher solids of the web makes the sheet stronger, whereby the risk of web breaks is reduced. Still further, the method according to the invention can be exploited by affecting the paper web with a chemical 3D capable of improving the surface qualities of the web and a web strength improving chemical 3E. Depending on the produced paper grade, desired effect of the chemical, the roll material, felts and other parameters, it is possible to formulate a combination of the chemicals 3A, 3B, 3C, 3D and 3E so as to obtain an optimal end result.

At least the following criteria can applied to define the necessary properties of the dosed chemical:

- must tolerate high temperatures (up to 200° C.) without undergoing an uncontrolled change of its composition
- must evaporate (become gaseous) with the evaporation of water, or alternatively, form an aerosol of extremely small droplet size when dosed along with the steam stream into the steam box,
- must tolerate high pressures (up to 200 kPa) without changing its composition,
- during dosing, the temperature of the diluted chemical shall be brought as close as possible to the boiling point of water in order to avoid a temperature drop of the steam injected into the steam box and to attain a sufficient concentration of the chemical in the injected steam,
- no concentration or temperature variations of the diluted chemical are allowable, because the dilution and temperature control of the chemical must be carried out in a controlled manner based on continuous measurement and control,
- no deviations from the continuous and smooth dosing of the diluted chemical are allowable, because the dosing of the chemical must be carried out in a controlled manner based on continuous measurement and control,
- the chemical can be in a gaseous, liquid or solid state such a pulverized material, and
- the carrier medium is a gas such as steam.

The invention also concerns an apparatus for treating a material web, said apparatus being suited to implement the method according to the invention and comprising a gas application/distribution device 4 such as a steam box adapted to direct and apply said gas 2, particularly steam, to a moving material web 1. The apparatus includes means for dosing at least one supplementary treatment agent 3 into the stream of said gas.

Further, the apparatus comprises means for conditioning said treatment agent prior to its dosing. Additionally, the apparatus may comprise means for diluting said treatment agent. Means for controlling the temperature of said treatment agent are included in said apparatus.

The apparatus further includes means for processing said treatment agent prior to its dosing. The apparatus may also include means for diluting said treatment agent. Means for controlling the temperature of said treatment agent are also included in the apparatus.

Figure 3:
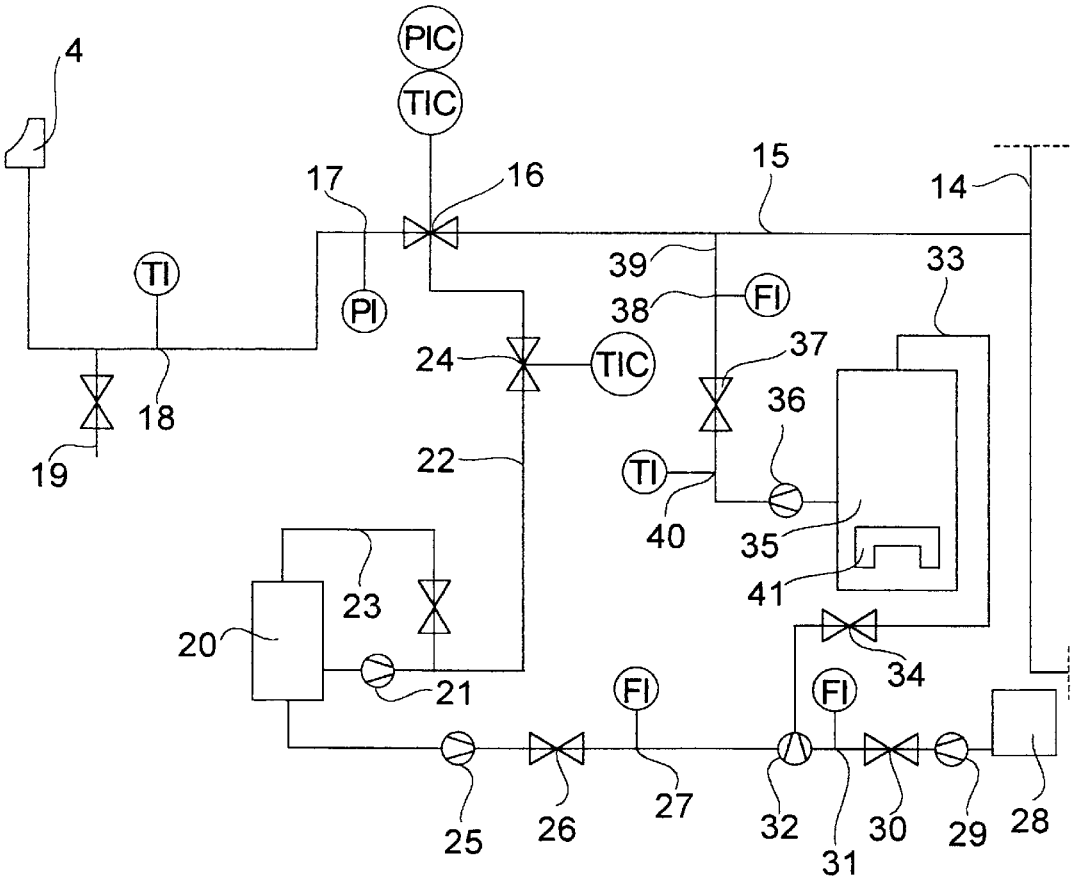
FIG. 3 shows a dosing system of a first embodiment according to the invention.

Referring to FIG. 3, therein is shown an embodiment of the apparatus according to the invention. The apparatus includes a conventional steam box 4, wherefrom the steam is directed from at least one opening against a continuously moving paper web. The steam is taken from a steam supply line 14 to a steam infeed pipe 15 of the steam box. The steam infeed pipe 15 has a control valve 16 serving for the adjustment of steam pressure, volume rate or temperature. The steam infeed pipe is further provided with temperature measurement means 18 and pressure measurement means 17. These transmit steam pressure and temperature data to the control valve 16. Finally, to the lowermost point of the steam infeed pipe 15, close to the steam box 4, is made a condensate trap 19 into which the nonevaporated water is collected for drainage. A condensate drain valve is adapted to operate in conjunction with the condensate trap 19. For flawless function of the paper machine, it is crucial that no droplets of water shall enter the steam box 4, because such droplets if allowed to impinge on the web could cause holes in the web and even web breaks.

The steam temperature is generally controlled by injecting cooling water at an elevated temperature and free from dissolved gas to avoid corrosion and assure that the injected water will undergo evaporation prior to the infeed of the steam into the steam box. Such cooling water can be normal heated water, deionized water or condensate (condensed water) obtained, e.g., from the condensed steam of the steam circulation in the paper machine dryer section. In the illustrated embodiment, the cooling water is taken from a condensate container 20 used as a storage for the condensate of the steam circulation. From the container, the condensate is pumped by means of a pump 21 along a condensate infeed pipe 22 to the control valve 16 of the steam infeed pipe 15. To the condensate infeed pipe 22 are connected both a condensate return pipe 23 with a valve adapted thereto for protecting the pump 21 and a control valve 24 for regulating the volume rate of condensate infeed.

The dilution of the chemical 3 applied in the implementation of the method according to the invention may be performed using either fresh water or as shown, e.g., condensate taken from the condensate container 20. The condensate is pumped by means of a pump 25 via a condensate flow-rate control valve 26 and condensate flow-rate transducer 27 to a mixing pump 32 of the chemical. The undiluted chemical is stored in a container 28. From the storage container, the chemical is pumped by means of a pump 29 via a chemical flow-rate control valve 30 and chemical flow-rate transducer 31 to a mixing pump 32 of the chemical. In the illustrated configuration, the mixing pump 32 performs mixing of the condensate with the undiluted chemical in an accurately measured and controlled ratio to a desired concentration. The concentration control is implemented with the help of the above-described flow-rate measurement means, control valves and metering pumps. By means of the mixing pump 32, the diluted chemical is moved along a diluted-chemical transfer pipe 33 via a valve 34 to a diluted-chemical storage container 35, or in some cases, directly into the steam infeed pipe 15. The diluted-chemical storage container 35 is provided with a heater element 41 serving to heat the chemical close to its boiling point. This arrangement assures immediate evaporation of the diluted chemical when injected into the steam infeed pipe 15 of the steam box. From the storage container 35, the diluted chemical is pumped by means of diluted-chemical metering pump 36 along the diluted-chemical dosing line 39 via a valve 37 and a flow-rate transducer 38 into the steam infeed pipe 15 of the steam box. Based on the signal of a temperature sensor 40 mounted on the diluted-chemical dosing line, the temperature of the chemical in the container 35 is adjusted with the help of the heater element 41. Based on the signal of the flow-rate transducer 38, the metered amount of the chemical is adjusted with the help of the metering pump 36.

Figure 4:
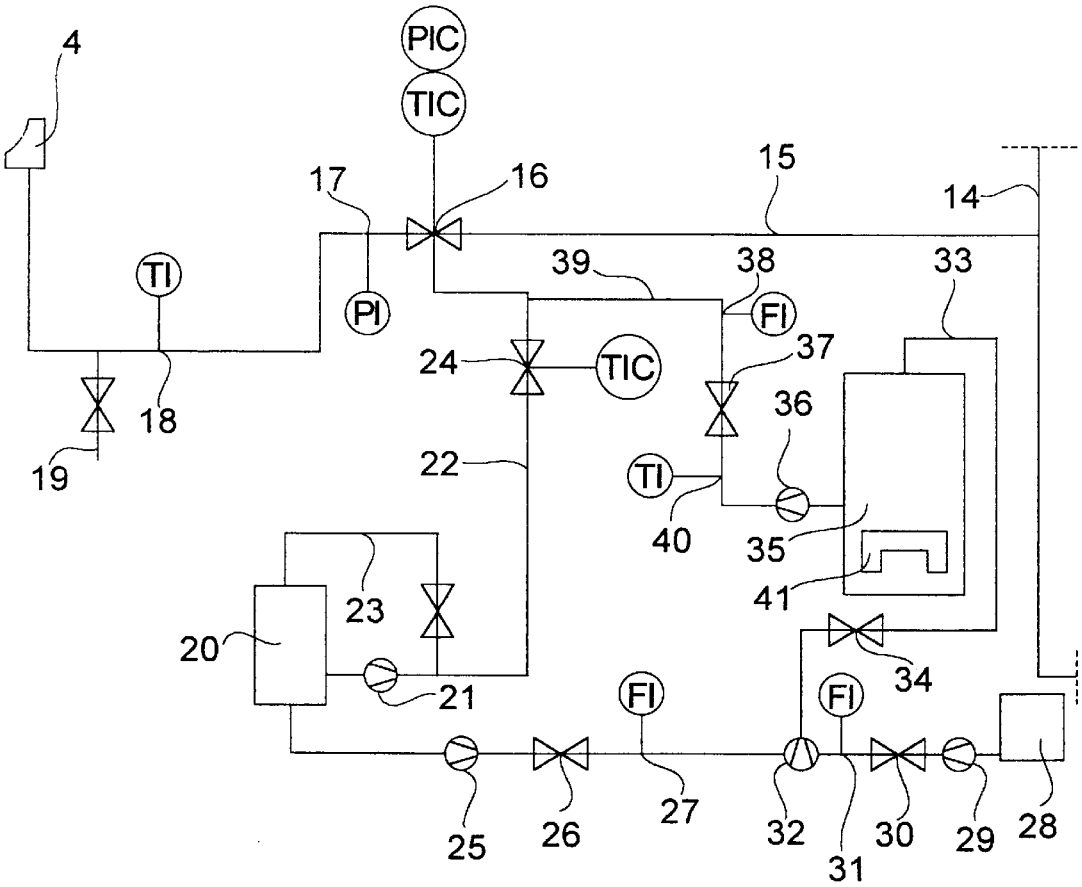
FIG. 4 shows the dosing system of a second embodiment of the invention according to the invention.

In FIG. 4 is shown another dosing apparatus according to the invention. Therein, the diluted-chemical dosing line 39 exits into a steam-temperature-controlling water line 22 that further exits into the steam infeed pipe 15. The chemical dosing line may be connected to any point of the temperature-controlling water line 22 or directly to the storage container 20 of the liquid used for steam temperature control or to the return pipe 23 of the liquid. Alternatively, it is possible to dose the chemical directly into the steam supply line 14 or to the condensate line discharging into the storage container 20. Most advantageously, the chemical is dosed either directly to the steam infeed pipe 15 or a pipe connected immediately thereto, such as the steam-temperature-controlling water line 22.

In the above-described embodiments, the treating agent is used in the form of a liquid chemical, which is further diluted prior to its injection into the stream of the carrier gas 2. Alternatively, the treatment agent can be in a gaseous or solid state such as a pulverized raw material. Still further, a combination of such agents may be used. The treatment agent can be, e.g., a chemical exerting its effect via various cation/anion surface state charges or a low surface tension of the chemical. Further, the chemical may act as a lubricant and contain various silicon or fluorinated compounds.

To those versed in the art it is obvious that the invention is not limited by the exemplifying embodiments described above, but rather, can be varied within the scope and spirit of the appended claims.

I claim:

1. A method of employing a supplementary treating agent in a papermaking apparatus wherein a moving paper product web is treated with a first fluid, the method comprising the steps of:

effecting a flow of the first fluid;

effecting a flow of at least one supplementary treatment agent selected from the group consisting of (a) an agent for modifying the strength of the paper product web, (b) an agent for facilitating the release of the web from a moving transport element in the papermaking apparatus, (c) an agent for modifying the surface tension of water to facilitate the removal of water from the web, (d) an agent for modifying the surface properties of the paper product and (e) an agent for lubricating mechanical elements in the papermaking apparatus;

combining the flows of the first fluid and the supplementary treating agent to produce a fluid mixture of the first fluid and the supplementary treating agent; and directing the fluid mixture toward the moving paper product web.

2. The method recited in claim 1, wherein the first fluid is steam.

3. The method recited in claim 2, wherein:

the flow of steam is directed to a steam box having an outlet adjacent to the moving paper product web;

the flow of the supplementary treatment agent is directed to the steam box; and the fluid mixture of the steam and the supplementary treatment agent is produced in the steam box.

4. The method recited in claim 2, wherein the fluid mixture of the steam and the supplementary treatment agent is directed to a steam box having an outlet adjacent to the moving paper product web.

5. The method recited in claim 1, wherein the flow of the first fluid is combined with a flow of at least two of the supplementary treatment agents to produce the fluid mixture.

6. The method recited in claim 1, wherein the supplementary treatment agent is a gas.

7. The method recited in claim 1, wherein the supplementary treatment agent is a liquid.

8. The method recited in claim 1, wherein the supplementary treatment agent is a finely divided solid.

9. The method recited in claim 1, and further comprising the steps of monitoring and controlling the flow rate of the supplementary treatment agent.

10. The method recited in claim 1, and further comprising the steps of monitoring and controlling the temperature of the supplementary treatment agent prior to combining the flow of the first fluid with the flow of the supplementary treatment agent.

11. The method recited in claim 1, and further comprising the step of:

combining a flow of a diluent with the supplementary treatment agent prior to combining the flow of the first fluid with the flow of the supplementary treatment agent.

12. The method recited in claim 11, and further comprising the steps of monitoring and controlling the flow rates of the supplementary treatment agent and the diluent to produce a desired dilution of the supplementary treatment agent.

* * * * *